US005806852A

United States Patent [19]

Howes

[11] Patent Number: 5,806,852

[45] Date of Patent: Sep. 15, 1998

[54] METHOD AND APPARATUS FOR RANDOMLY DISTRIBUTING PRIZE AWARDS

[76] Inventor: James P. Howes, 122 St. Johns Rd., Wilton, Conn. 06897

[21] Appl. No.: 799,102

[22] Filed: Feb. 11, 1997

Related U.S. Application Data

[60] Provisional application No. 60/011,767, Feb. 12, 1996.

[51] Int. Cl.[6] ..... A63F 3/06

[52] U.S. Cl. ..... 273/138.1; 273/139; 273/288

[58] Field of Search ..... 273/138.1, 139, 273/269, 288, 287, 249, 260

[56] References Cited

U.S. PATENT DOCUMENTS 5,076,433 12/1991 Howes ..... 273/138.1
5,449,179 9/1995 Hefferan ..... 273/269

FOREIGN PATENT DOCUMENTS 3525304 1/1987 Germany ..... 273/288

OTHER PUBLICATIONS

Jul. 1993 Topps Stadium Club baseball cards, Master Photo winner card, The Topps Company, Inc.,

*Primary Examiner*—Benjamin H. Layno
*Attorney, Agent, or Firm*—Melvin I. Stoltz

[57] ABSTRACT

By constructing an actual product in a distinctive and readily identifiable manner and distributing the uniquely constructed product with conventional products, a unique prize winning notifier or indicator for a promotional contest is realized. Preferably, each prize notifying or indicating product is manufactured as an actual, individual product, using generally conventional production method, and comprises a unique, distinguishable, feature or characteristic which designates such products as prize winners. As a result, prize identifying products are packaged and sold in direct association with non-prize related products, without any degradation, contamination, or other difficulties as previously encountered with prior art systems or promotional vehicles.

16 Claims, 2 Drawing Sheets

METHOD AND APPARATUS FOR RANDOMLY DISTRIBUTING PRIZE AWARDS

RELATED APPLICATIONS

This application is related to Provisional Application Ser. No. 60/011,767 filed Feb. 12, 1996.

TECHNICAL FIELD

This invention relates to prize awarding systems and, more particularly, to prize awarding systems employable with solid, dry, liquid or moist, consumable, manufactured product for randomly distributing a prize award intermixed with actual, non-prize related products.

BACKGROUND ART

Various promotional enhancements have been widely used by companies in order to increase the sale of the companies' products. These promotions are employed by both manufacturers and distributors for a wide variety of diverse products. Although these promotional enhancements take many forms, ranging from price reductions, prize awards, games, contests, etc., the sole purpose for all of these promotions is to increase the sale of the underlying product.

One of the promotional methods often employed by manufacturers is the inclusion of a prize in either every product container or in selected containers. In order to attain greater market share for product sales, manufacturers and distributors have utilized a variety of different promotional themes, seeking to generate added sales for their particular products. In doing so, the premium or prize-like promotion has progressed from inexpensive give-aways packed in every product bearing container to expensive prize awards which are packed in selected containers. If possible, prize bearing containers are randomly distributed with non-prize bearing containers.

Although these various promotional vehicles have become very popular with some types of products, the ability of certain types of food products to be able to use a prize award directly associated with the product has been extremely limited. In this regard, only prize awards which can be separately packaged in acceptable containers and then inserted with the food product being distributed have been capable of being commercially feasible. As a result, many food products have been incapable of enjoying the benefits derived from promotional vehicles commonly employed with other types of product. Due to this inability, manufacturers or distributors of numerous food products have been incapable of employing an effective product sales incentive in order to generate increased interest and sales for their respective products.

Therefore, it is a principal object of the present invention to provide a promotional system which is capable of being employed easily and conveniently in connection with a wide variety of consumer products, such as food products and beauty aid products which are used by individuals either entirely or externally.

Another object of the present invention is to provide a prize awarding system and promotional method having the characteristic features described above which is capable of being implemented in a simple, straightforward manner, without requiring massive changes in manufacturing processes for the products being promoted.

Another object of the present invention is to provide a prize awarding system and promotional method having the characteristic features described above which enables virtually any consumer oriented product to be easily promoted in a contest which generates a high level of interest and excitement.

Other and more specific objects will in part be obvious and will in part appear hereinafter.

SUMMARY OF THE INVENTION

By employing the present invention, the prior inabilities have been completely overcome and any manufactured food product sold individually, or sold in groups of individual portions, is now capable of enjoying the benefits of increased sales resulting from prize award contests. In the present invention, the actual food product is constructed in a unique manner and distributed as the prize winning notifier or indicator. Such prize identifying products are packaged and sold in direct association with non-prize related products, without any degradation, contamination, or other difficulties as previously encountered with prior art systems or promotional vehicles.

In accordance with the present invention, each prize notifying or indicating product is manufactured as an actual, individual, consumable product, using the generally conventional production method. However, some specific, selected products are constructed with a unique, distinguishable, feature or characteristic which designates such products as prize winners. In this way, consumers are capable of receiving the actual product intended to be purchased, with that product incorporating a special designation immediately disclosing to the consumer that the particular product represents that a prize has been won.

By manufacturing the actual product, which the consumer expects to find in the package, with a unique, distinguishing feature or characteristic for designating a prize award or a prize winning element or indicator, the normal packaging employed by the manufacturer can be employed. In addition, the particular product which represents a prize awarding product may be constructed in a variety of ways to provide a unique, distinguishing feature or characteristic which is readily visible to the consumer, or easily determined by the consumer, allowing the consumer to immediately understand that a particular prize has been won or a game piece has been received for being employed in a prize awarding game.

In accordance with the teaching of the present invention, a wide variety of different, unique, distinguishing features or characteristics may be employed, either individually or in combination with such feature or characteristic, incorporated into a particular product to provide a prize designating/awarding function for the product. However, regardless of the unique, distinguishing feature or characteristic employed, the prize designating product is manufactured using the substantially identical process for normal, non-prize designating products. As a result, prize designating products are easily intermixed with normal, non-prize designating products, enabling complete random distribution of prize designating products with conventional, non-prize related products.

By employing this present invention, consumers are unable to distinguish, in advance, which products are prize related products and which products contain no prize award. Only upon opening of the container for the product is the consumer able to discover whether any prize related or prize awarding product is contained in the purchased product. In this way, substantial excitement is created in the minds of the consumer by purchasing products and opening the product to discover if a prize award is found. As a result, the present invention provides excitement and interest in the product being purchased, wherein no such promotion was previously possible.

In accordance with the present invention, the unique, distinguishing features or characteristics imparted to the consumable product to designate a prize award or contest preferably comprises one or more selected from the group consisting of indicia, icons, color, messages, shapes, sizes, flavors, and taste. Regardless of which features or characteristics are employed, or which combination of features or characteristics are employed, a unique, distinguishing product is attained which is readily identifiable by the consumer after opening the container to reveal the products contained therein.

Although any manufactured product can employ the present invention, the present invention is particularly applicable to molded or formed products sold individually or in groups, or to wet or moist products. Typically all of the products comprise food or consumable products. Included in this product category are hard and soft candies, mints, jelly beans, wafers, breath mints, biscuits, cookies, cereals, syrups, yogurts, puddings, juices, soft drinks, milk, soups, toothpaste, etc. In accordance with this invention, each product is manufactured in the conventional manner, with prize designating products being constructed with a specific, unique, distinguishable feature or characteristic incorporated therewith to readily distinguish the prize designating product from non-prize designating products.

Although a variety of constructions or manufacturing procedures may be employed in implementing the present invention, unique distinguishing features or characteristics are most easily included as part of the product, to designate a prize award or contest, by forming indicia on the product or in the product by embossing, debossing, or blind embossing. In this regard, the indicia may comprise a particular icon, design, logo, or message which immediately identifies the product as a prize designating product, distinguishing the product from non-prize designating products. Alternatively, the product can be formed with a special shape, flavor, taste, or color integrally associated therewith which would distinguish the prize related product from the conventional, non-prize related products. A particular taste or flavor is particularly useful for wet or moist products.

The invention accordingly comprises the several steps and relation of one or more of such steps with respect to each of the others, and the articles possessing the features, properties, and the relation of elements, which are exemplified in the following detailed disclosure, and the scope of the invention will be indicated in the claims.

THE DRAWINGS

For a fuller understanding of the nature and objects of the present invention, reference should be had to the following drawings, in which.

Figure 8:
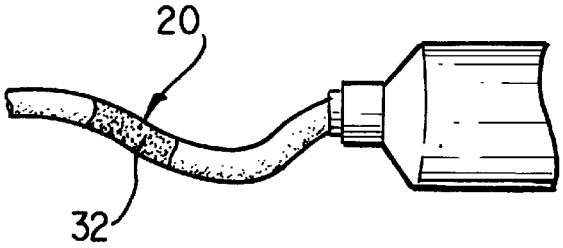
Figure 9:
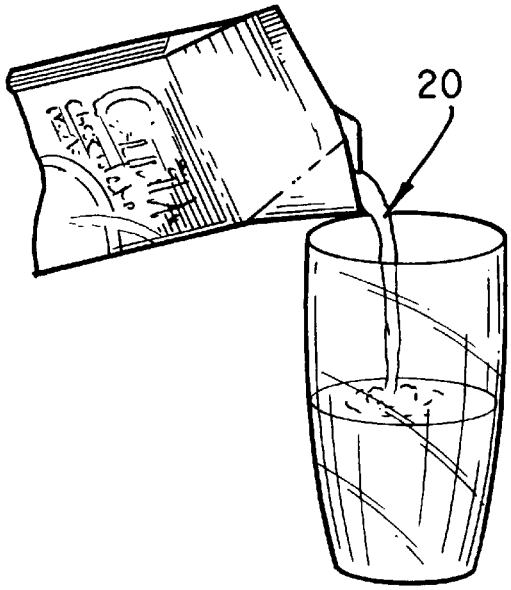

FIG. 8 is a plan view of a still further alternate embodiment of the present invention wherein the product is manufactured incorporating color directly associated with the product as designating the prize awarded product as compared to normal prize awarded products; and FIG. 9 is a front elevational view depicting a still further alternate embodiment of the present invention wherein taste is employed for distinguishing prize awarded products from non-prize awarded products.

DETAILED DISCLOSURE

As shown in FIGS. 1–9, the prize award system of the present invention is implemented using a wide variety of alternate constructions or configurations, with each of these constructions being fully applicable to a wide variety of different products. In its preferred implementation, the present invention is particularly applicable to creating prize awarding systems for use with the sale and distribution of solid or dry consumable manufactured products. For purposes of illustration, FIGS. 1–9 depict the present invention fully implemented in connection with the manufacture and sale of formed, edible, candy products, such as hard candies and breath mints, as well as other food products and consumer beauty aids. However, it is to be understood that FIGS. 1–9 are provided as examples of the implementation of the present invention and all other dry, solid, moist or wet manufactured products can employ the present invention and are intended to be within the scope of this invention.

Figure 1:
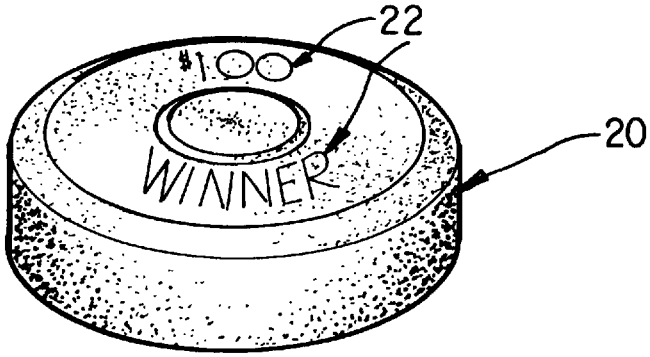
FIG. 1 is a perspective view of one formed product manufactured in accordance with the present invention.

In FIG. 1, a prize awarding or prize designating product 20, manufactured in accordance with the present invention and shown as an edible candy or breath mint product, is depicted in a generally conventional circular configuration. However, in accordance with the present invention, product 20 incorporates specific prize awarding indicia 22 embossed directly in product 20 in order to immediately inform the consumer that a prize award has been won.

As depicted in FIG. 1, the recipient of product 20 is immediately informed that a $100 prize has been won by merely reading indicia 22 formed in product 20 which states "$100 Winner". By forming any desired prize awarding indicia 22 in product 20, any desired prize award can be made to the consumer of the product. In this way, any desired dollar amount or prize can be stated by the indicia formed on product 20. Furthermore, indicia 22 can be formed in any desired manner on product 20, such as by embossing, debossing, or blind embossing. Furthermore, indicia 22 can be created by a flavor change or color change, using the actual product as the main ingredients.

By employing the present invention, product 20 is manufactured in its generally conventional manner to form the desired product using the conventional components and formulation. However, in order to create specific products 20 which incorporate prize awarding indicia 22, specific mold or forming elements are employed which provide the precise prize award designation desired by the manufacturer.

In this embodiment, product 20 is manufactured with prize awarding indicia 22 formed directed therewith by employing a special mold or forming means that incorporates components for embossing or debossing a particular designation, such as "$100 Winner". Based upon the desired number of $100 winners sought by the manufacturer, that number of products 20 would be formed, with those products then being randomly intermixed with conventional, non-prize awarding products for packaging and distribution to consumers.

Similarly, all other prize awards would be manufactured in a substantially identical manner, thereby enabling the manufacturer to randomly distribute prize awarding or prize designating products 20 amongst the total universe of product bearing packages being manufactured and distributed. This assures wide distribution of the prize awards among all pre-packaged products. By employing this invention, added excitement and interest is generated by the consumers since those particular products within which a prize award designating product is contained is unknown to the consumer, until the packaging has been opened.

Once all of the prize awarding or prize designating products 20 have been formed, using a particular feature or characteristic desired by the manufacturer, such as indicia, icons, color, messages, shapes, sizes, flavors, and tastes, the prize designating products are then intermixed with conventional, non-prize designating products for being randomly distributed throughout the entire universe of manufactured products.

The intermixing or seeding of prize designating or prize awarding product 20 with non-prize designating products can be achieved using a wide variety of various methods. One efficient method would be to package non-prize designating products in the conventional holder, such as a wrapper, bag, box, etc., and prior to closing the packages, prize designating products would be randomly distributed in selected packages, after which each package would be sealed in the normal manner. In this way, seeding or prize designating product 20 among the universe of non-prize designating products and packages, can be controllably attained and the precisely desired quantity of prize designating products can be intermixed with the desired number of non-prize designating products. By employing this procedure, complete control over the prize awarding levels is realized as well as broad distribution of the prize awarding products throughout all of the manufactured products.

Figure 2:
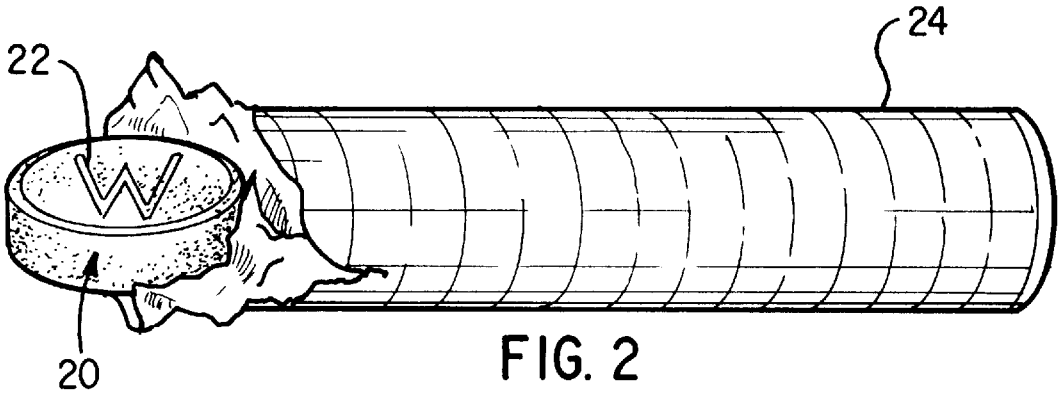
FIG. 2 is a perspective view of a fully assembled container of formed products with one end thereof opened displaying an alternate embodiment of the formed product manufactured in accordance with the present invention.

As shown in FIG. 2, product 20 is assembled in a generally conventional package 24 wherein a plurality of non-prize designating products are contained and peripherally surrounded by packaging 24. In this embodiment, prize awarding indicia 22 is formed on product 20 in an embossed relief form represented as the letter "W", designating a winner.

In this construction, as many winning products 20 can be constructed by the manufacturer, in the generally conventional manner for forming product 20, with the winning products being randomly distributed among all of the otherwise conventional, non-prize awarding products. Only upon opening package 24 and removing the products therefrom is a consumer able to determine whether any prize has been won. In this way, substantial interest and excitement is created as the consumer seeks to use the products in order to see if any winning products 20 are contained in a particular package 24.

Figure 3:
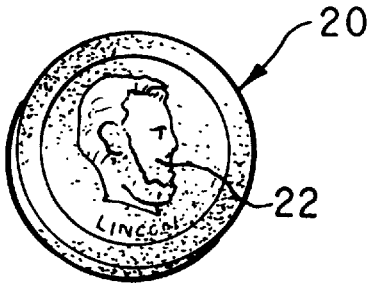
FIGS. 3 and 4 are top plan views of formed products manufactured in accordance with an alternate embodiment of the present invention.
Figure 4:
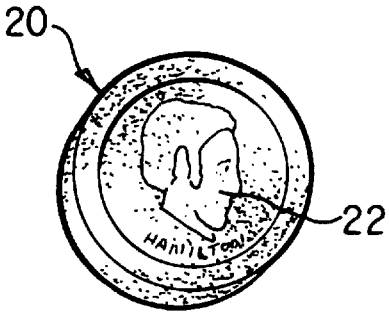

In FIGS. 3 and 4, two alternate embodiments of the present invention are depicted. In this embodiment, product 20 is formed with a visual representation of a famous person formed on product 20 as indicia 22. In FIG. 3, a visual representation of President Lincoln is provided as indicia 22, while FIG. 4 depicts a visual representation of Alexander Hamilton as indicia 22.

In carrying out this particular embodiment of the present invention, indicia 22 is constructed to visually represent a president or famous American which corresponds to the president or famous American depicted on U.S. currency. In this way, any consumer who finds product 20 with indicia 22 printed thereon immediately recognizes that a prize has been won, with the prize corresponding to the currency upon which the particular president or famous American appears.

As a result, an individual receiving President Lincoln, as depicted in FIG. 3, would win $5.00, while any individual receiving Alexander Hamilton, as shown in FIG. 4, would be a winner of $10.00. Similarly, all other presidents or famous Americans appearing on higher value currency could also be employed, in the identical manner, in order to designate an immediate cash prize award.

Figure 5:
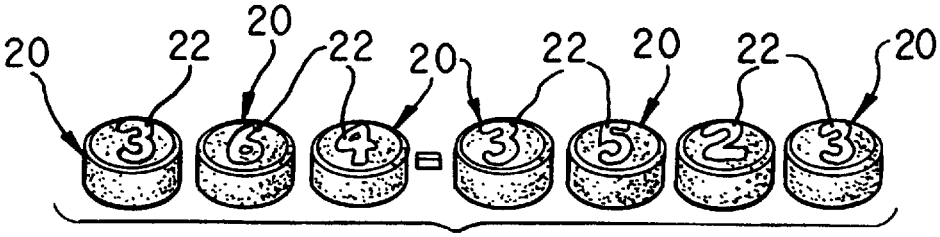
FIG. 5 is a perspective view of a plurality of formed products manufactured in accordance with a further alternate embodiment of the present invention.

In FIG. 5, a further alternate embodiment of the prize awarding system of the present invention is depicted. In this embodiment, each prize identifying product 20 is formed with indicia 22 integrally formed therewith as a particular numeral. These indicia bearing products would then be randomly seeded with conventional non-indicia bearing products in the manner detailed above.

In this embodiment, consumers are able to win prize awards by collecting indicia-bearing products 20 with the numerals corresponding to their telephone numbers. Upon collecting sufficient numeral bearing products with the appropriate numerals representing an individual's telephone number, the individual would then be able to win a prize award which has been previously established by the manufacturer for the contest.

By employing this embodiment, complete random success for all individuals is attained, with all numeral bearing products 20 being randomly distributed over the entire universe of non-prize related products. Furthermore, individuals are likely to purchase additional products in order to participate in the contest, seeking to obtain the particular numerals for completing their telephone number.

If desired, any other specific numeral designation or verbal designation can be employed in substantially the same manner. As a result, one's social security number could be the object of being established by a collection of appropriate numerals. Furthermore, if desired, individual letters could be formed on product 20 for spelling out one's name, using a collection of letters.

Figure 6:
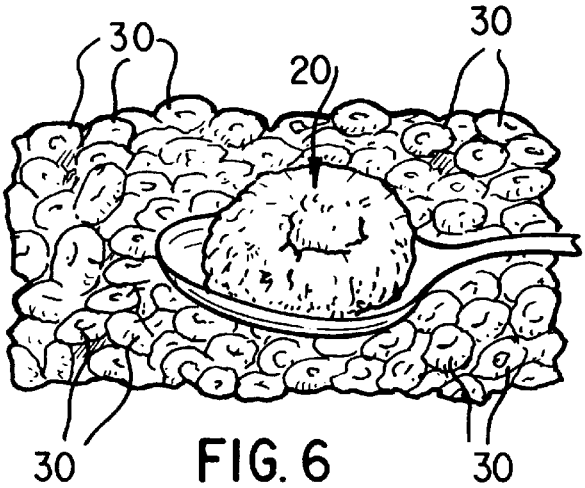
FIG. 6 is perspective view of an alternate embodiment of the present invention wherein a prize designating product is formed with a substantially different size as compared to the size of the typical, non-prize designating products.

In FIG. 6, a still further alternate embodiment of the prize awarding system of the present invention is depicted. In this embodiment, the prize awarding system of the present invention is employed with circular shaped cereal products 30, and prize designating or prize awarding product 20 is constructed with a size substantially greater than the conventional size of cereal product 30.

By employing this embodiment of the present invention, a lucky consumer upon using product 30 would immediately recognize the presence of a substantially larger prize awarding product 20 amongst the conventional size product 30. Once this enlarged prize awarding product 20 is found, the consumer would then qualify for the prize award designated by the manufacturer.

Figure 7:
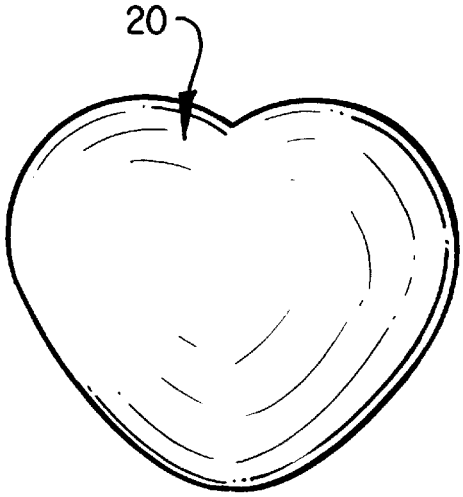
FIG. 7 is a still further alternate embodiment of the present invention wherein the product itself is formed in a unique, distinctive shape, strikingly different from the shape normally employed for the product.

In FIG. 7, a still further alternate embodiment of the present invention is shown. In this embodiment, each prize awarding or prize designating product 20 is formed in a unique shape which is completely distinctive and readily identifiable.

In this embodiment, soap products are depicted employing the present invention. As is well known, normal soap bars are found in rectangular or round configurations. Consequently, by forming prize awarding or prize designating soap product 20 in a strikingly different, unique, and readily identifiable shape, such as the heart shape depicted in FIG. 7, a unique prize awarding system is realized. Upon opening a conventional package, any consumer finding uniquely shaped prize awarding or prize designating product 20 contained therein would immediately know that a prize has been won. The heart shape shown in FIG. 7 merely comprises one shape which is distinctive and strikingly different from the conventional shape found for such soap products. However, any alternate, distinctive shape can be employed with equal efficacy.

In employing this embodiment of the present invention, advertising literature can be incorporated into the normal packaging to inform consumers of the various prizes that are being awarded for different shapes. Consequently, a consumer upon finding a heart shape, could immediately discover the particular prize that has been won. Then, the consumer can redeem the prize by either returning the heart shaped prize awarding product 20 to the manufacturer or, if allowed, sending the manufacturer a photograph of the heart shape prize awarding product 20, which would then enable the consumer to use product 20, since prize awarding product 20 is preferably manufactured in virtually the same manner as conventional products.

In FIG. 8, a further alternate embodiment of the present invention is depicted. In this embodiment, color is employed for designating prize awarding products 20 and distinguishing prize awarding products 20 from non-prize awarding products. Although color can be implemented in a wide variety of alternate configurations, FIG. 8 depicts a strikingly unique configuration, wherein a toothpaste product is constructed with a plurality of readily identifiable color zones 32 formed as part of the toothpaste and constructed to be displayed as a user employs the toothpaste. Once a consumer sees the color identifying indicia 32 forming a part of the toothpaste, the consumer immediately becomes aware that the toothpaste container is a prize designating or prize awarding container which can be redeemed for the associated prize.

Although FIG. 8 depicts the use of color in association with toothpaste products, it is immediately apparent to one of ordinary skill in the art that color can be employed in association with any product and is constructed with one or more colors normally associated therewith. By manufacturing some of the products with a strikingly unique, distinctive or alternate color which is readily identifiable by consumers, the present invention can be easily employed with any desired product. By intermixing the special colored, prize designating products 20 with the conventional products in the normal packaging associated with the product, consumers will be incapable of determining in advance whether a prize awarding product is contained in the package. Only upon opening the package will the special color, prize designating product 20 be revealed, informing the consumer that a particular prize has been won.

In FIG. 9, a final alternate embodiment of the present invention is depicted. In this embodiment, taste is employed for designating a prize award and immediately revealing to the consumer that a prize bearing container or product 20 is in the possession of the consumer. In the embodiment depicted in FIG. 9, a container of chocolate milk is constructed with an alternate flavoring, such as strawberry. Upon opening the product for use and finding a taste or flavoring completely different from the expected taste or flavoring, a consumer is immediately aware that the product is a prize awarding or prize designating product 20. Then, following the instructions provided by the manufacturer, redemption of the product can be attained.

As is evident from the foregoing detailed disclosure, the present invention overcomes all of the prior art drawbacks and achieves an easily employed promotional contest for use with a wide variety of products which has heretofore been incapable of employing such promotional games or prize award systems. By employing this invention, all of the prior art drawbacks are eliminated and manufacturers of products are capable of achieving a completely random, unknown prize award hidden in any desired product, with the consumer only being capable of discovering the prize award upon opening the product. As a result, excitement, interest, and anticipation are achieved in the marketplace. Furthermore, products which were incapable of enjoying any type of promotion are now able to realize the benefits derived by such contests.

It will thus be seen that the objects set forth above, among those made apparent from the preceding description, are efficiently attained and, since certain changes may be made in carrying out the above method and in the articles set forth without departing from the scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, that I claim as new and desire to secure by Letters Patent is:

1. A method for randomly distributing prize awards to consumers in direct association with non-prize designating products comprising the steps of A. forming conventional non-prize designating, edible, food products;

B. forming a prize designating, edible, food product from substantially the same components as the non-prize designating, edible, food product, with the prize designating, edible, food product incorporating a readily identifiable prize designating feature, element or characteristic integrally formed as a part of the prize designating, edible, food product itself;

C. randomly intermixing prize designating, edible, food products with non-prize designating, edible, food products;

D. packaging the intermixed prize designating and non-prize designating, edible, food products in the conventional manner; and E. randomly distributing packages bearing prize designating, edible, food products with packages bearing only non-prize designating edible products;

whereby a promotional, prize awarding system is attained whereby uniquely constructed products represent prize awarding products capable of distribution with conventional, non-prize designating products.

2. The method defined in claim 1, wherein the readily identifiable feature, element, or characteristic comprises at least one selected from the group consisting of indicia, icon, color, message, shape, size, flavor, and taste.

3. The method defined in claim 2, wherein the product forming both prize designating products and non-prize designating products comprises a consumer product used by an individual either internally or externally.

4. The method defined in claim 1, wherein said edible product comprises one selected from the group consisting of candy, mints, jelly beans, wafers, breath mints, biscuits, cookies, cereals, syrups, yogurt, puddings, juices, soft drinks, milk, soup, and toothpaste.

5. The method defined in claim 4, wherein said readily identifiable feature comprises one selected from the group consisting of shape, size, and taste.

6. The method defined in claim 1, wherein said readily identifiable feature comprises an indicia.

7. The method defined in claim 6, wherein said indicia comprises one selected from the group consisting of icons, logos, messages and colors.

8. The method defined in claim 7, wherein said indicia defines the prize associated therewith.

9. A method for randomly distributing prize awards to consumers in direct association with non-prize designating products comprising the steps of A. forming conventional non-prize designating, edible, food products;

B. forming a prize designating, edible, food product from substantially the same components as the non-prize designating, edible, food product, with the prize designating edible, food product incorporating a readily identifiable prize designating feature, element or characteristic integrally formed as a part of the prize designating, edible, food product itself and said readily identifiable prize designating feature, element, or characteristic is not formed on the packaging or wrapper of the product;

C. randomly intermixing prize designating products with non-prize designating, edible, food products;

D. packaging the intermixed prize designating and non-prize designating, edible, food products in the conventional manner; and E. randomly distributing packages bearing prize designating, edible, food products with packages bearing only non-prize designating, edible, food products.

10. A prize designating, edible, food product for use in a prize awarding promotional contest, said prize designating, edible, food product being manufactured in a substantially conventional manner using ingredients substantially equivalent to ingredients employed in manufacturing non-prize designating, edible, food products, said prize designating, edible, food product comprising at least one readily identifiable feature or characteristic integrally formed as a part of the prize designating, edible, food product itself for distinguishing said prize designating, edible, food product from non-prize designating, edible, food products.

11. The prize designating product defined in claim 10, wherein said feature or characteristic comprises one selected from the group consisting of indicia, icons, color, messages, shapes, sizes, flavors, and tastes.

12. The prize designating product defined in claim 11, wherein said feature comprises prize designating indicia formed on the outer surface of the product.

13. The prize designating product defined in claim 12, wherein said indicia comprises one selected from the group consisting of messages, logos, colors, and icons.

14. The prize designating product defined in claim 13, wherein said indicia designates the specific prize that has been won.

15. The prize designating product defined in claim 11, wherein said feature comprises the taste of the product.

16. The prize designating product defined in claim 11, wherein the features comprise one selected from the group consisting of size and shape.

* * * * *